US009267366B2

(12) United States Patent
Parsche

(10) Patent No.: US 9,267,366 B2
(45) Date of Patent: Feb. 23, 2016

(54) APPARATUS FOR HEATING HYDROCARBON RESOURCES WITH MAGNETIC RADIATOR AND RELATED METHODS

(71) Applicant: HARRIS CORPORATION, Melbourne, FL (US)

(72) Inventor: Francis Eugene Parsche, Palm Bay, FL (US)

(73) Assignee: HARRIS CORPORATION, Melbourne, FL (US)

( * ) Notice: Subject to any disclaimer, the term of this patent is extended or adjusted under 35 U.S.C. 154(b) by 469 days.

(21) Appl. No.: 13/788,301

(22) Filed: Mar. 7, 2013

(65) Prior Publication Data

US 2014/0251597 A1 Sep. 11, 2014

(51) Int. Cl.
*E21B 43/24* (2006.01)

(52) U.S. Cl.
CPC ..... *E21B 43/2401* (2013.01)

(58) Field of Classification Search
CPC ..... E21B 43/2401
See application file for complete search history.

(56) References Cited

U.S. PATENT DOCUMENTS 4,144,935 A * 3/1979 Bridges et al. ..... 166/248
4,196,329 A * 4/1980 Rowland et al. ..... 219/772
4,524,826 A * 6/1985 Savage ..... 166/248
5,182,427 A * 1/1993 McGaffigan ..... 219/663
5,236,039 A * 8/1993 Edelstein et al. ..... 166/248
5,248,865 A 9/1993 Tyler
7,441,597 B2 10/2008 Kasevich
7,461,693 B2 * 12/2008 Considine et al. ..... 166/248
7,479,859 B2 1/2009 Gerber
7,863,861 B2 1/2011 Cheng et al.
7,940,151 B2 5/2011 Parsche et al.
2010/0078163 A1 4/2010 Banerjee et al.
2010/0294488 A1 11/2010 Wheeler et al.
2010/0294489 A1 11/2010 Dreher, Jr. et al.
2011/0309988 A1 * 12/2011 Parsche ..... 343/793
2012/0018140 A1 * 1/2012 Parsche ..... 166/60
2012/0067572 A1 * 3/2012 Trautman et al. ..... 166/272.3
2012/0067580 A1 * 3/2012 Parsche ..... 166/302

OTHER PUBLICATIONS

Tau et al., "Reducing the Viscosity of Crude Oil by Pulsed Electric or Magnetic Field," Energy & Fuels, vol. 20, No. 5, 2006, pp. 2046-2051.

* cited by examiner

*Primary Examiner* — Benjamin Fiorello
(74) *Attorney, Agent, or Firm* — Allen, Dyer, Doppelt, Milbrath & Gilchrist, P.A.

(57) ABSTRACT

An apparatus is for heating hydrocarbon resources in a subterranean formation having a wellbore therein. The apparatus includes an RF source, and a magnetic field radiator including a ferromagnetic body having an aboveground portion and a belowground portion coupled thereto. The magnetic field radiator includes a conductive wire coil surrounding the aboveground portion and coupled to the RF source so that an RF current through the conductive wire coil magnetizes the ferromagnetic body and generates a magnetic field from the belowground portion to heat the hydrocarbon resources.

18 Claims, 4 Drawing Sheets

APPARATUS FOR HEATING HYDROCARBON RESOURCES WITH MAGNETIC RADIATOR AND RELATED METHODS

FIELD OF THE INVENTION

The present invention relates to the field of hydrocarbon resource processing, and, more particularly, to a hydrocarbon heating apparatus and related methods.

BACKGROUND OF THE INVENTION

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in sands where their viscous nature does not permit conventional oil well production. This category of hydrocarbon resource is generally referred to as oil sands. Estimates are that trillions of barrels of oil reserves may be found in such oil sand formations.

In some instances, these oil sand deposits are currently extracted via open-pit mining. Another approach for in situ extraction for deeper deposits is known as Steam-Assisted Gravity Drainage (SAGD). The heavy oil is immobile at reservoir temperatures, and therefore, the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the payzone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen, which allows it to flow down into the lower producer well where it is collected and recovered. The steam and gases rise due to their lower density. Gases, such as methane, carbon dioxide, and hydrogen sulfide, for example, may tend to rise in the steam chamber and fill the void space left by the oil defining an insulating layer above the steam. Oil and water flow is by gravity driven drainage urged into the lower producer well.

Operating the injection and production wells at approximately reservoir pressure may address the instability problems that adversely affect high-pressure steam processes. SAGD may produce a smooth, even production that can be as high as 70% to 80% of the original oil in place (OOIP) in suitable reservoirs. The SAGD process may be relatively sensitive to shale streaks and other vertical barriers since, as the rock is heated, differential thermal expansion causes fractures in it, allowing steam and fluids to flow through. SAGD may be twice as efficient as the older cyclic steam stimulation (CSS) process.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a large-scale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, while Venezuelan production has been declining in recent years. Oil is not yet produced from oil sands on a significant level in other countries.

U.S. Published Patent Application No. 2010/0078163 to Banerjee et al. discloses a hydrocarbon recovery process whereby three wells are provided: an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Patent Application No. 2010/0294489 to Dreher, Jr. et al. discloses using microwaves to provide heating. An activator is injected below the surface and is heated by the microwaves, and the activator then heats the heavy oil in the production well. U.S. Published Patent Application No. 2010/0294488 to Wheeler et al. discloses a similar approach.

U.S. Pat. No. 7,441,597 to Kasevich discloses using a radio frequency generator to apply radio frequency (RF) energy to a horizontal portion of an RF well positioned above a horizontal portion of an oil/gas producing well. The viscosity of the oil is reduced as a result of the RF energy, which causes the oil to drain due to gravity. The oil is recovered through the oil/gas producing well.

Unfortunately, long production times, for example, due to a failed start-up, to extract oil using SAGD may lead to significant heat loss to the adjacent soil, excessive consumption of steam, and a high cost for recovery. Significant water resources are also typically used to recover oil using SAGD, which impacts the environment. Limited water resources may also limit oil recovery. SAGD is also not an available process in permafrost regions, for example, or in areas that may lack sufficient cap rock, are considered "thin" payzones, or payzones that have interstitial layers of shale. While RF heating may address some of these shortcomings, further improvements to RF heating may be desirable.

SUMMARY OF THE INVENTION

In view of the foregoing background, it is therefore an object of the present invention to provide an apparatus for heating hydrocarbon resources that is efficient and robust.

This and other objects, features, and advantages in accordance with the present invention are provided by an apparatus for heating hydrocarbon resources in a subterranean formation having a wellbore therein. The apparatus comprises an RF source, and a magnetic field radiator comprising a ferromagnetic body (e.g. ferrite) comprising an aboveground portion and a belowground portion coupled thereto, and a conductive wire coil surrounding the aboveground portion and coupled to the RF source so that an RF current through the conductive wire coil magnetizes the ferromagnetic body and generates a magnetic field from the belowground portion to heat the hydrocarbon resources. Advantageously, the magnetic field radiator may apply a directed magnetic field to heat the hydrocarbon resources for extraction.

More specifically, the belowground portion may comprise first and second spaced apart legs. The conductive wire coil may comprise a plurality of wire loops around the aboveground portion of the ferromagnetic body. Also, the apparatus may further comprise a producer well adjacent the belowground portion of the ferromagnetic body.

Another aspect is directed to a method for heating hydrocarbon resources in a subterranean formation having a wellbore therein with an apparatus comprising an RF source, and a magnetic field radiator comprising a ferromagnetic body comprising an aboveground portion and a belowground portion coupled thereto, and a conductive wire coil surrounding the aboveground portion. The method comprises operating the RF source to be coupled to the conductive wire coil so that an RF current passes through the conductive wire coil and magnetizes the ferromagnetic body and generates a magnetic field from the belowground portion to heat the hydrocarbon resources.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
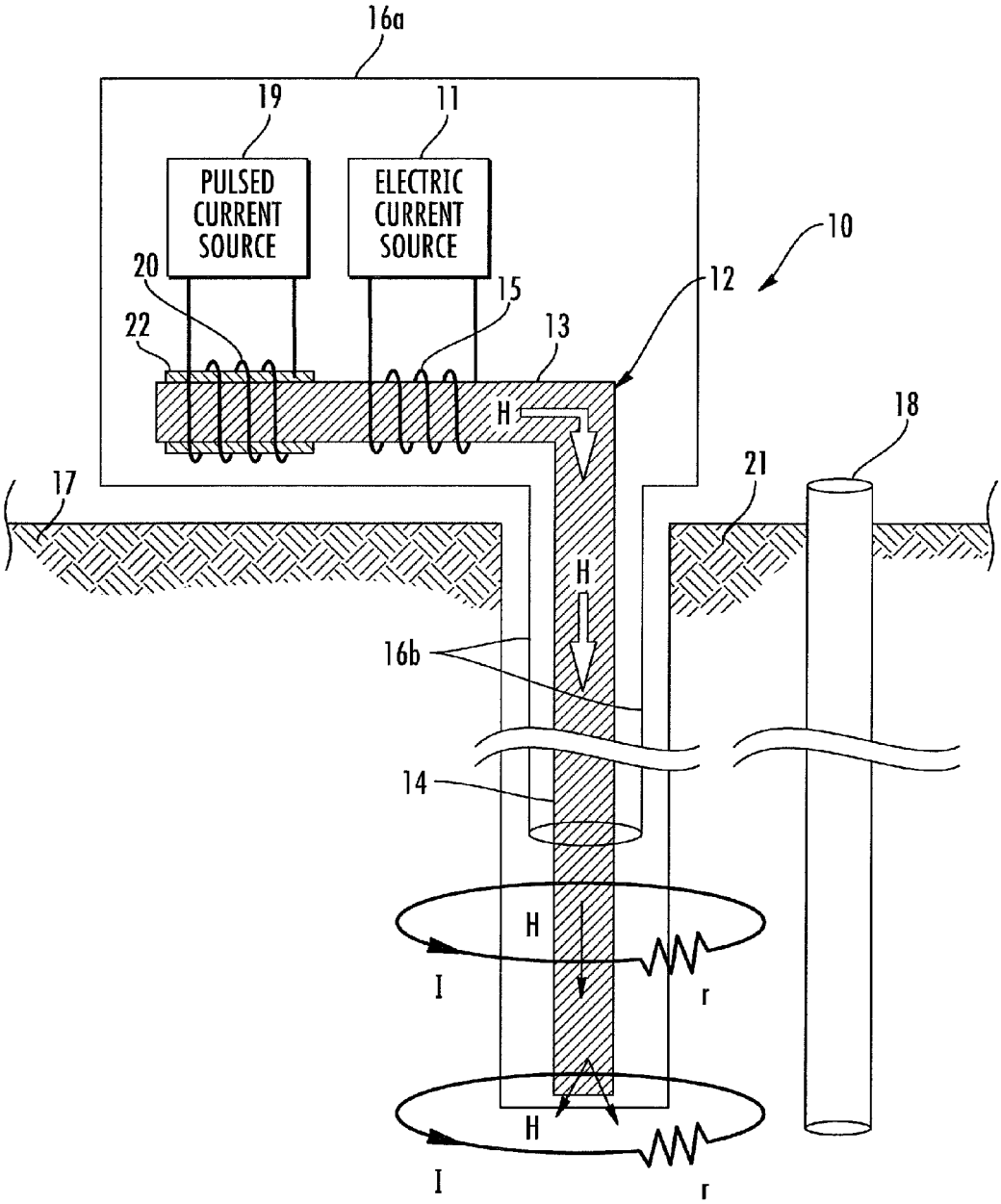
FIG. 1 is a schematic diagram of an apparatus for heating hydrocarbons, according to the present invention.

Referring initially to FIG. 1, an apparatus 10 for heating hydrocarbon resources according to the present invention is now described. In particular, the apparatus 10 is heating hydrocarbon resources in a subterranean formation 17 having a wellbore therein. The apparatus 10 comprises an RF source (RF current source) 11, a pulsed direct current (DC) source 19, and a magnetic field radiator 12. The magnetic field radiator 12 includes a ferromagnetic body comprising an aboveground portion 13 and a belowground portion 14 coupled thereto. Also, a producer well 18 is located adjacent the belowground portion 14 of the ferromagnetic body.

More specifically, the aboveground and belowground portions 13-14 of the apparatus 10 may be made of at least one of iron, nickel, cobalt, manganese, gadolinium, and dysporium, or may be made of a bulk electrically nonconductive matrix, such as an insulated macrostructure: laminations or filaments, coated grain powders, and polycrystalline lattices, such as garnet and spinel, ferrite, or $NiOFe_2O_3$. The above and belowground portions 13-14 are preferentially made of a magnetic material having low electrical conductivity in bulk. Also, providing a bulk electrically nonconductive magnetic radiator 12 reduces Eddy electric current losses in the aboveground and belowground portions 13-14.

The magnetic field radiator 12 includes a conductive wire coil 15 adjacent, i.e. surrounding, the aboveground portion 13 and coupled to the RF source 11 so that an RF current passing through the conductive wire coil magnetizes the ferromagnetic body and generates a time varying or RF magnetic field from the belowground portion 14 to heat the hydrocarbon resources. In short, the belowground portion 14 acts as a magnetic conductor or "magnetic circuit" for conveying the magnetic fields generated by the conductive wire coil 15 and the aboveground portion 13 to the subterranean formation 17.

The magnetic field radiator 12 may include a DC conductive wire coil 20 adjacent, i.e. surrounding, the aboveground portion 13 and coupled to the pulsed DC source 11. A pulsed DC current from the pulsed DC current source 19 passes through the DC conductive wire coil 20 to magnetize the ferromagnetic body and generate a pulsed magnetic field in the belowground portion 14, which is conveyed to the subterranean formation 17. The combination of the DC conductive wire coil 20 and the aboveground and belowground portions 13-14 may provide a powerful electromagnet for application of pulsed quiescent magnetic fields to a hydrocarbon bearing subterranean formation 17. Pulsed, steady state magnetic and electric fields provided by the present embodiments may thin viscous hydrocarbons by modifying the hydrocarbon rheological properties. For instance, the apparatus 10 may thin heavy crude oil in a subterranean formation 17 by agglomerating suspended asphalt particles, and do so sufficiently for well stimulation, see, e.g., "Reducing The Viscosity Of Crude Oil By Pulsed Electric or Magnetic Field" T. Tau and X. Zu, Energy and Fuels 2006, 20, 2046-2051, pub. American Chemical Society.

The apparatus 10 may include an electrically conductive shield (magnetic shield) **16*a*, 16*b* for preventing unwanted electromagnetic radiation at the surface, to avoid unwanted heating at the surface 21, and to avoid unwanted heating in overburden regions above a payzone strata. The electrically conductive shield 16*a* may comprise an electrically conductive enclosure, such as a metal building enclosing the aboveground portion 13. The electrically conductive shield 16*b* may be an electrically conductive pipe enclosing the magnetic field radiator 12, say through overburden where heating is to unwanted. The electrically conductive shields 16*a*, 16*b* may be electrically bonded where they meet. Wall thickness for the electrically conductive shields 16*a*, 16*b*** may preferentially be 2 or more RF skin depths thick, such as say 0.049 inches thick for carbon steel, or 0.016 inches thick for copper at 100 kilohertz radio frequency.

As background, electrical conductors, such as copper and carbon steel, will both shield magnetic fields at radio frequencies by the formation of Eddy electric currents on their surfaces. Electrical conductors also shield the RF electric fields by acting as a "Faraday Cage". The apparatus may include an isolating shield 22 to isolate the DC magnetic conductive wire coil 15 from the RF conductive wire coil 20. The interwinding isolating shield 22 may be a metal tube, such a copper tube, over the aboveground portion 13. DC magnetic fields will penetrate the isolating shield 22 tube but RF magnetic fields will not, so RF energy does not reach the pulsed DC current source 19.

Advantageously, the magnetic field radiator 12 applies a magnetic field H to heat the hydrocarbon resources for extraction. A preferred heating method is magnetic induction of Eddy electric currents in the subterranean formation 17. This method is compound and occurs by the following steps: 1) magnetic field radiator 12 applies radio frequency magnetic fields H into the subterranean formation 17; 2) the applied magnetic fields H induce the flow of eddy electric currents I in the subterranean formation 17, since a time varying magnetic field is always accompanied by current flow in conductive media, Amperes and Lents Laws; 3) the eddy electric currents I then dissipate as heat in the subterranean formation 17 intrinsic electrical resistance r by Joule Effect So, the apparatus 10 provides a reliable method of electrode free resistance heating in a subterranean formation 17.

Advantageously, the present embodiments may be free from concerns of water boil off earth electrodes, which would interrupt the heating. The present embodiments may provide other methods of subterranean heating as well, such as electric field induction according to Faraday's Law, a form of capacitive coupling, which occurs in the following steps: 1) The magnetic field radiator 12 applies magnetic fields to the subterranean formations 17; 2) electric fields E form in the payzone according to Faraday's Law, as a time-varying magnetic field is always accompanied by a spatially-varying electric field; and 3) the induced electric field E then provides dielectric heating in subterranean formation 17 polar molecules.

Any heating in the magnetic core of the magnetic field radiator 12 can cause conducted heating into the subterranean formation 17. A ferromagnetic subterranean formation 17 may heat by magnetic hysteresis losses. Also, in some embodiments, the magnetic field heating of the apparatus 10 can be combined with other forms of subterranean hydrocarbon heating, such as SAGD, etc. Indeed, the apparatus 10 could further include an injector well (not shown) to inject water, saltwater or solvents such as alkanes. Injected alkane solvents may reduce subterranean operating temperatures and efficiency. Hydrocarbons often occur with connate liquid water, such as subterranean pore water covered by hydrocarbon films. When present the pore water induction heat first and the associated hydrocarbons quickly heat by thermal conduction from the pore warmed pore water.

In the illustrated embodiment, the belowground portion 14 extends vertically from the surface 21 of the subterranean formation 17. In other embodiments, the wellbores may bend and become horizontal directional drilling (HDD) wells. The RF source 11 may be configured to operate at a frequency between 40 Hertz and 40 Megahertz, and it is understood that the RF source 11 may supply time varying electric currents to include alternating currents, sine wave currents, and wave forms other than size waves, such square, sawtooth or serrasoid waveforms. A method of the present embodiments is to adjust the radio frequency to control the speed and penetration depth of the heating, higher frequencies will generally increase the speed of the heating and lower frequencies will reduce the speed. Lower frequencies may increase penetration depth into the subterranean formation 17, due to radio frequency skin depth increase. The operating frequency of the RF source 11 may need to be tuned to best heat the hydrocarbons in the subterranean formation 17 while balancing losses incurred during transmission down the wellbore. The underground portion 14 of the ferromagnetic body may be formed, for example, by joining a plurality of ferromagnetic segments, each having threaded ends for connecting with each other. In other embodiments, a concrete mixture including a ferromagnetic powder can be poured into the wellbore, such as a slurry of water, presintered ferrite powder, and Portland cement powder.

Figure 2:
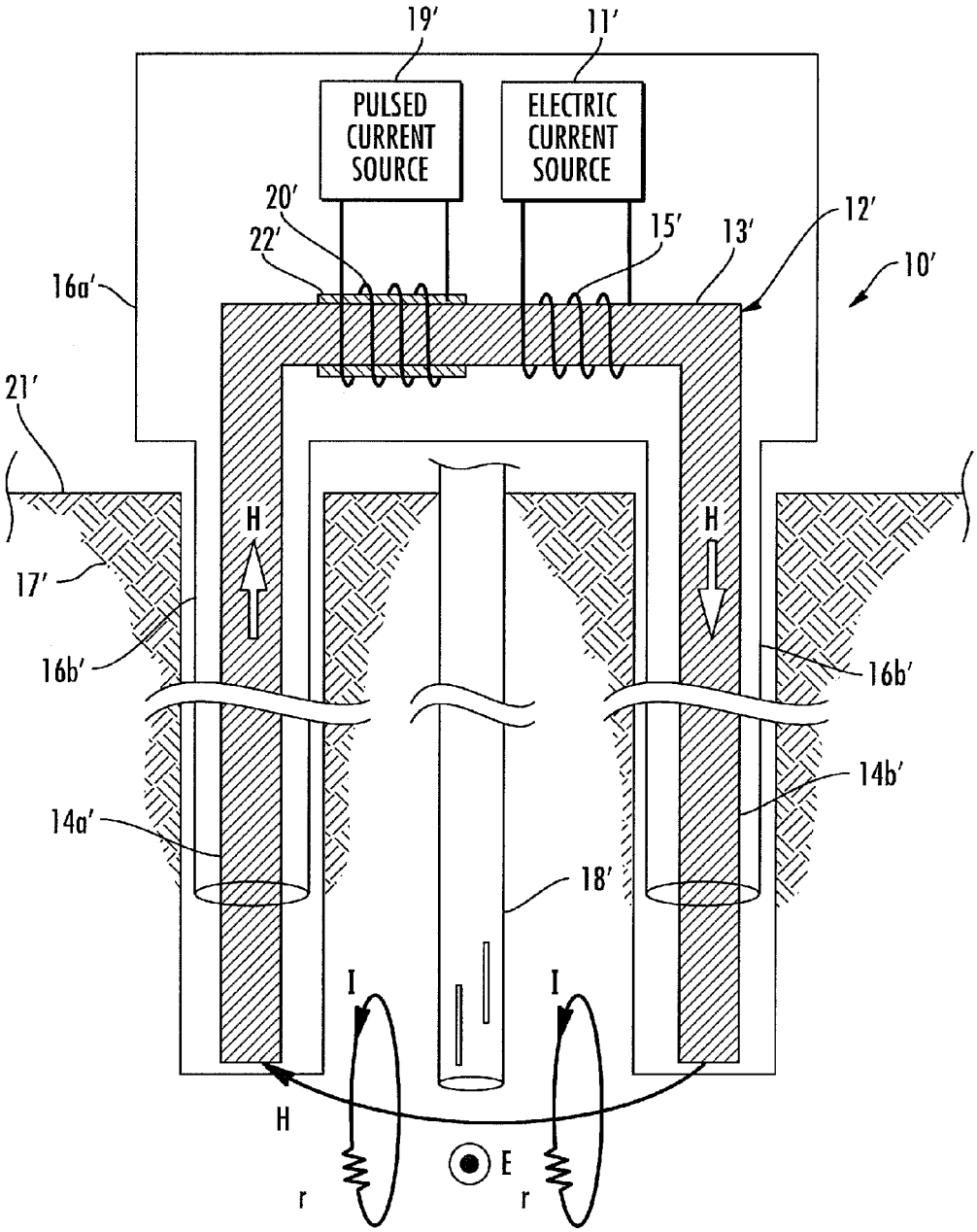
FIG. 2 is a schematic diagram of another embodiment of an apparatus for heating hydrocarbons, according to the present invention.

Referring now to FIG. 2, another embodiment of the apparatus 10' is now described. The apparatus 10' may provide improved efficiency, control and placement of the magnetic induction heating, it provides a nearly complete magnetic circuit to convey the magnetic fields into the subterranean formation 17. In this embodiment of the apparatus 10', those elements already discussed above with respect to FIG. 1 are given prime notation and most require no further discussion herein. This embodiment differs from the previous embodiment in that the belowground portion includes first and second spaced apart legs **14*a*'-14*b*', i.e. a horseshoe like formation. Also, the conductive wire coil 15' comprises a plurality of wire loops wrapped around the aboveground portion 13' of the ferromagnetic body, which connect the first and second spaced apart legs 14*a*'-14*b*'. The apparatus 10' includes a shield layer 16*a*'-16*b*' adjacent the ferromagnetic body at an upper end thereof. More specifically, the shield layer 16*b*' extends into the wellbore, and includes a portion 16*a*' covering the surface 21' of the subterranean formation 17' adjacent the ferromagnetic body. For example, the shield layer 16*a*' may comprise a metal building or metal ground mat and serves as a Faraday cage. Advantageously, the openings in the mesh of the shield layer 16*a*'-16*b*' may be selectively sized based upon the operating wavelength of the RF source 11'. In particular, the shield layer 16*a*'-16*b*' may comprise copper and may reduce the amount of magnetic field penetrating and heating the overburden, which enhances the efficiency of the apparatus 10'. Moreover, in some embodiments, the portion of the shield 16*b*'** that extends into the wellbore may comprise a conductive tube, for example, solid tube or a mesh surfaced tube.

Another aspect is directed to a method for heating hydrocarbon resources in a subterranean formation 17 having a wellbore therein with an apparatus comprising an RF source 11, and a magnetic field radiator 12 comprising a ferromagnetic body comprising an aboveground portion 13 and a belowground portion 14 coupled thereto, and a conductive wire coil 15 adjacent the aboveground portion. The method comprises operating the RF source 11 to be coupled to the conductive wire coil 15 so that an RF current passes through the conductive wire coil and magnetizes the ferromagnetic body and generates a magnetic field from the belowground portion 14 to heat the hydrocarbon resources.

A method of the embodiments is to impart a DC or quiescent magnetic field in the magnetic radiator 12, 12' to reduce the radio frequency dissipative losses in the magnetic material comprising magnetic radiator. A quiescent magnetic field bias may reduce magnetic radiator 12, 12' dissipative losses by reducing magnetic material hysteresis loss and eddy current loss. Thus, the conductive wire coil 20 may function to supply this quiescent magnetic field bias to reduce RF losses, in addition to supplying pulsed DC magnetic fields to the subterranean formation 17. Measured test data disclosed in U.S. Pat. No. 7,940,151 to Parsche et al., assigned to the present application's assignee, and hereby incorporated by reference in its entirety, has previously demonstrated reduced dissipative losses in ferrite core inductors by the application of quiescent magnetic fields to a ferrite core.

Figure 3:
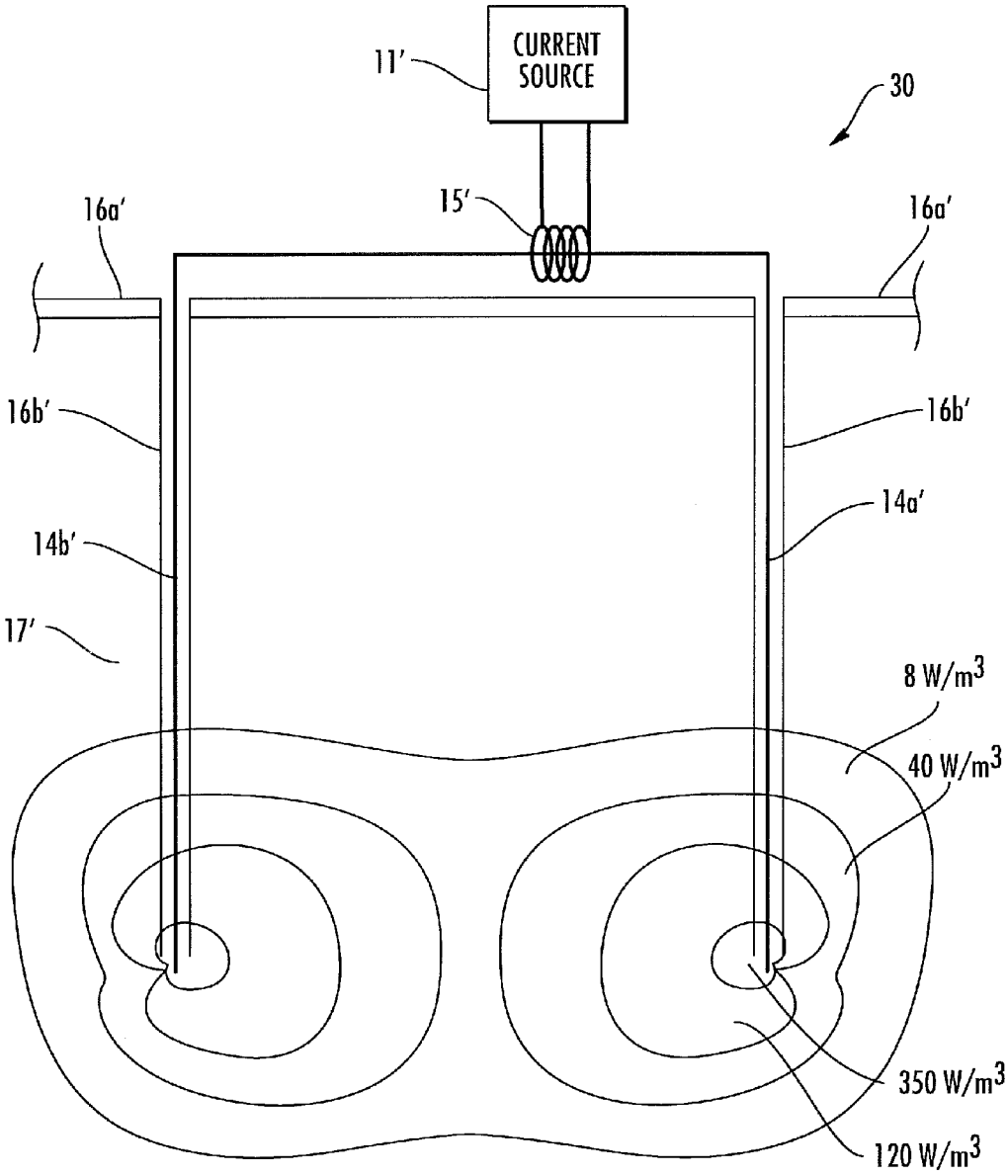
FIG. 3 is a diagram illustrating magnetic heating performance for the apparatus of FIG. 2.

Referring to FIG. 3, a diagram 30 illustrates the heating rate contours in of the subterranean formation 17' with the apparatus 10' (with the shield **16*a*'-16*b*' removed) during a simulation. In this simulation, the RF source 11' is operating at a frequency of 100 kHz and the subterranean formation 17' comprises homogenous earth of rich oil sand 0.01 mhos/meter electrical conductivity. The first and second spaced apart legs 14*a*'-14*b*' comprise 100 m deep ferrite filled wells that are 0.2 meters in diameter and spaced 50 meters apart. The relative magnetic permeability of the first and second spaced apart legs 14*a*'-14*b*' is 1000. As demonstrated, induction heating occurs in the payzone layer of the subterranean formation 17**.

Figure 4:
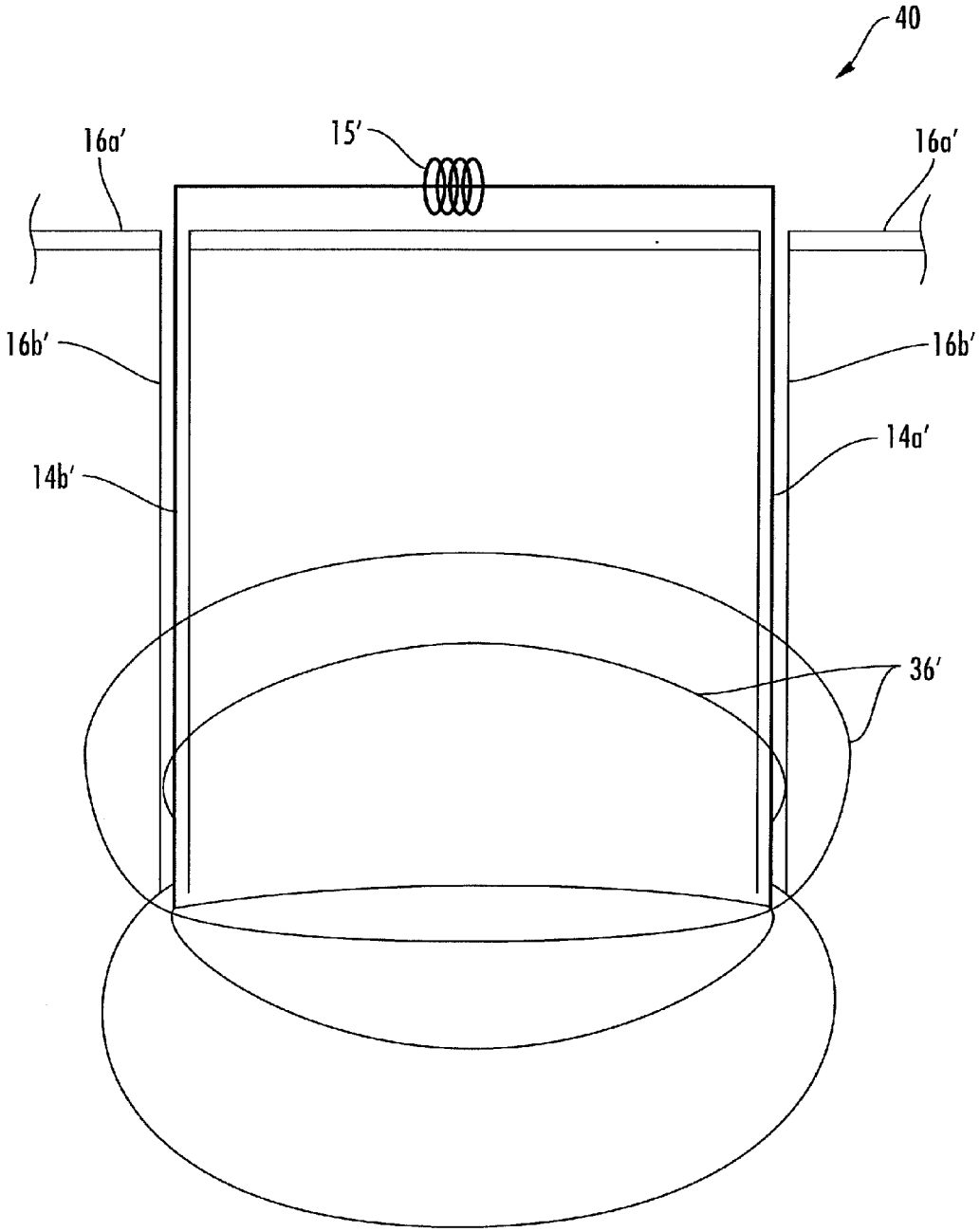
FIG. 4 is a diagram illustrating magnetic field performance for the apparatus of FIG. 2.

Referring now to FIG. 4, a diagram 40 illustrates magnetic field generation for the same simulation. Advantageously, the magnetic fields are concentrated between the first and second spaced apart legs **14*a*'-14*b*'**, which may be located in hydrocarbon payzone layer.

The practicality of the present embodiments at large scale may readily be illustrated. Consider that in an electrical utility grid, power transformers operate at power levels of 10 megawatts or more, so the transformer core magnetic circuit also conveys 10 megawatts power between spaced apart windings. The present embodiments, in a sense, substitutes Eddy currents in a hydrocarbon payzone for a transformer winding, and 10 megawatts is sufficient scale for heating hydrocarbon payzones.

Applying magnetic fields to the subterranean formation 17 avoids unreliable electrode contact. Additionally, heating by time varying magnetic fields may have numerous advantages over SAGD well heating as often inadequate surface water resources are not required; caprock is not required over the pay to contain the steam; a steam plant is not required over permafrost where surface melting may occur; shale strata in stranded pay zones will not preclude the passage of the magnetic heating fields; magnetic heating of the subterranean formation can shatter impermeable layers, such as shale; and the magnetic field heating can be much faster than SAGD as the slow and unreliable process of conducted heating is not needed to initiate the convective flow of steam. Moreover, the RF magnetic fields can thin the oil by modifying the rheological properties of the oil by agglomeration of asphalt particles. Hydrocarbon molecular cracking may also occur due to the electric fields that form in association with the magnetic fields, by dielectric breakdown and other mechanisms.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An apparatus for heating hydrocarbon resources in a subterranean formation having a wellbore therein, the apparatus comprising:

a radio frequency (RF) source; and a magnetic field radiator comprising a ferromagnetic body comprising a ferromagnetic aboveground portion and a ferromagnetic belowground portion coupled thereto, and a conductive wire coil surrounding said ferromagnetic aboveground portion and coupled to said RF source so that an RF current through said conductive wire coil magnetizes said ferromagnetic body and generates a magnetic field from said ferromagnetic belowground portion to heat the hydrocarbon resources.

2. The apparatus of claim 1 wherein said ferromagnetic body comprises ferrite.

3. The apparatus of claim 1 further comprising a shield layer adjacent said ferromagnetic body at an upper end thereof.

4. The apparatus of claim 3 wherein said shield layer extends into the wellbore.

5. The apparatus of claim 3 wherein said shield layer comprises an electrically conductive mesh layer.

6. The apparatus of claim 1 wherein said ferromagnetic belowground portion comprises first and second spaced apart legs.

7. The apparatus of claim 1 wherein said conductive wire coil comprises a plurality of wire loops around said ferromagnetic aboveground portion of said ferromagnetic body.

8. The apparatus of claim 1 wherein said RF source is configured to operate at a frequency equal to or greater than 100 kHz.

9. An apparatus for heating hydrocarbon resources in a subterranean formation having a wellbore therein, the apparatus comprising:

a radio frequency (RF) source; and a magnetic field radiator comprising a ferrite body comprising a ferromagnetic aboveground portion and a ferromagnetic belowground portion coupled thereto, said ferromagnetic belowground portion comprising first and second spaced apart legs, and a conductive wire coil surrounding said ferromagnetic aboveground portion and coupled to said RF source so that an RF current through said conductive wire coil magnetizes said ferrite body and generates a magnetic field from said ferromagnetic belowground portion to heat the hydrocarbon resources.

10. The apparatus of claim 9 further comprising a shield layer adjacent said ferrite body at an upper end thereof.

11. The apparatus of claim 10 wherein said shield layer extends into the wellbore.

12. The apparatus of claim 10 wherein said shield layer comprises an electrically conductive mesh layer.

13. The apparatus of claim 9 wherein said conductive wire coil comprises a plurality of wire loops around said ferromagnetic aboveground portion of said ferrite body.

14. The apparatus of claim 9 wherein said RF source is configured to operate at a frequency equal to or greater than 100 kHz.

15. A method for heating hydrocarbon resources in a subterranean formation having a wellbore therein with an apparatus comprising a radio frequency (RF) source, and a magnetic field radiator comprising a ferromagnetic body comprising a ferromagnetic aboveground portion and a ferromagnetic belowground portion coupled to the ferromagnetic aboveground portion, and a conductive wire coil surrounding the ferromagnetic aboveground portion, the method comprising:

operating the RF source coupled to the conductive wire coil to cause an RF current to pass through the conductive wire coil and magnetize the ferromagnetic body for generating a magnetic field from the ferromagnetic belowground portion to heat the hydrocarbon resources.

16. The method of claim 15 further comprising using a shield layer adjacent the ferromagnetic body at an upper end thereof.

17. The method of claim 15 further comprising operating the RF source to pass current through the conductive wire coil comprising a plurality of wire loops around the ferromagnetic aboveground portion of the ferromagnetic body.

18. The method of claim 15 further comprising operating the RF source to operate at a frequency equal to or greater than 100 kHz.

* * * * *